US005413501A

United States Patent [19]

Munn

[11] Patent Number: 5,413,501

[45] Date of Patent: May 9, 1995

[54] ELECTRICAL OUTLET

[76] Inventor: Roger D. Munn, 6520 Dorchester Rd., Apt. 2900-G, Charleston, S.C. 29418

[21] Appl. No.: 188,685

[22] Filed: Jan. 31, 1994

[51] Int. Cl.[6] ..... H01R 23/02

[52] U.S. Cl. ..... 439/535; 439/516; 439/622; 439/488

[58] Field of Search ..... 439/488, 490, 516, 622, 439/535, 536, 538, 107; 337/187-189

[56] References Cited

U.S. PATENT DOCUMENTS

| | | | |
|---|---|---|---|
| 2,256,716 | 9/1941 | Klancnik | 337/187 |
| 3,046,372 | 7/1962 | Civitano | 337/189 |
| 3,489,985 | 1/1970 | Martin | 439/516 |
| 3,622,840 | 11/1971 | Kahn | 361/626 |
| 3,717,836 | 2/1973 | Humphreys | 337/271 |
| 3,938,068 | 2/1976 | Hagan | 439/622 |
| 4,249,035 | 2/1981 | Watley | 439/187 |
| 4,659,161 | 4/1987 | Holcomb | 439/590 |
| 4,951,025 | 8/1990 | Finnegan et al. | 337/187 |

*Primary Examiner*—Gary F. Paumen

[57] ABSTRACT

An electrical outlet for supplying electrical power to electrical devices comprising a hollow receptacle box having a central opening; a plurality of electrical receptacles disposed within the box, each receptacle having a positive terminal, a negative terminal, and a ground terminal coupled thereto, each terminal adapted to receive a terminal wire of a power cable, each electrical receptacle adapted to receive an external male connector plug of an electrical device, pairs of electrical contacts coupled to the receptacle box and adapted to receive respective male connector plugs through their respective external receptacles, a fuse coupled between each pair of electrical contacts and their respective positive terminals for discontinuing the conduction of electrical power, means for providing an indication when the maximum power rating is exceeded in each receptacle, and means for allowing a user to configure the receptacles to be active at all times or to be controlled with an external switch; and a receptacle cover coupled over the central opening of the receptacle box adjacent to the peripheral edge thereof to seal the receptacles therein, the receptacle cover having a pair of holes disposed therein to allow access to the receptacles.

2 Claims, 3 Drawing Sheets

FIG. 1
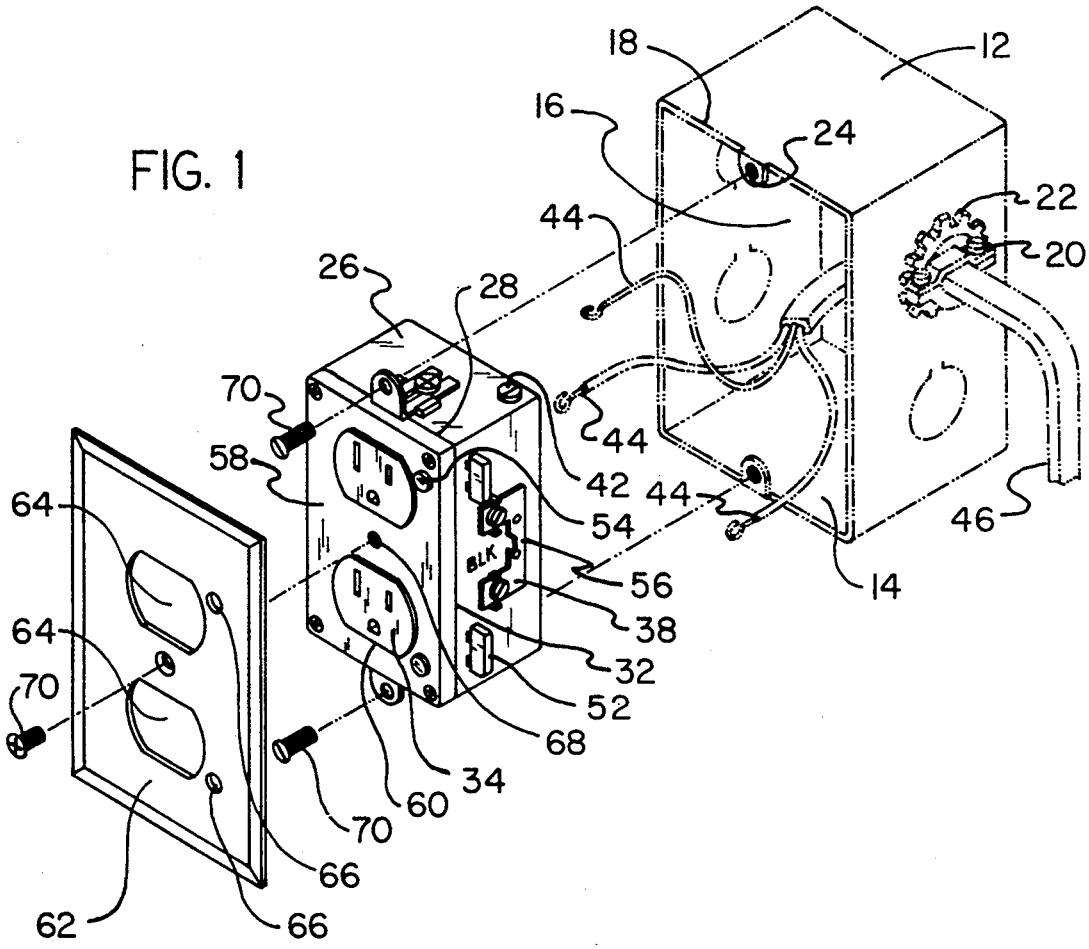
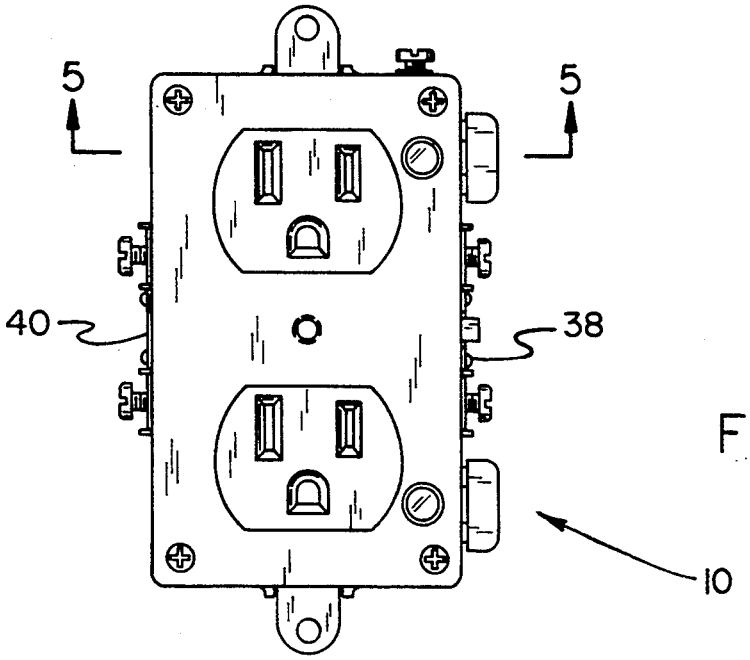
FIG. 2

FIG. 3
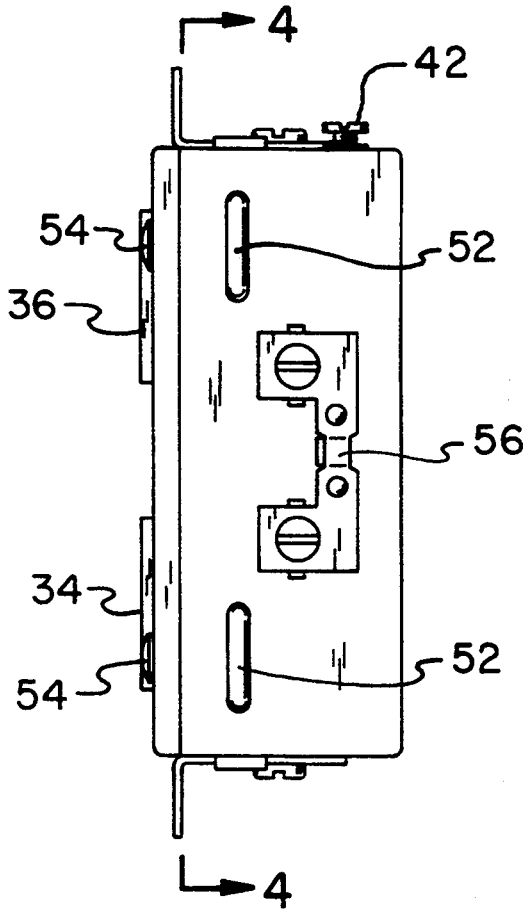
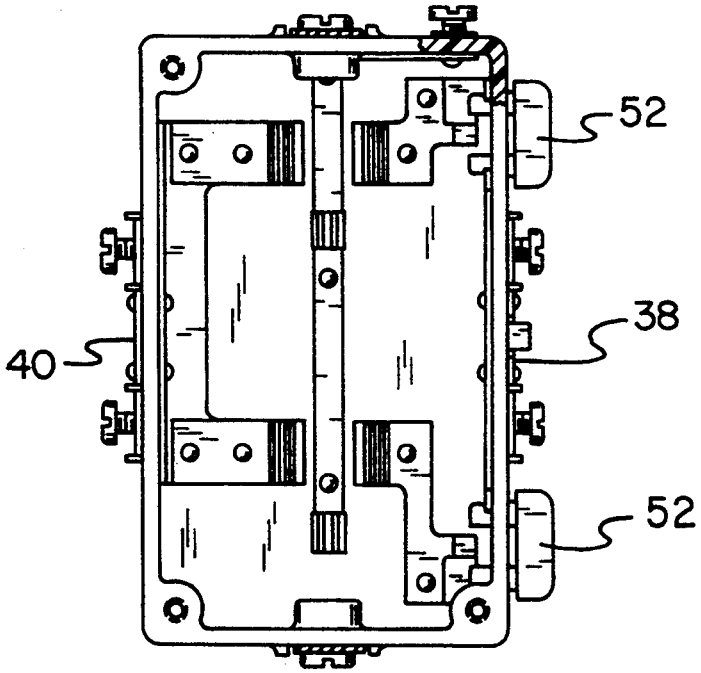
FIG. 4

ELECTRICAL OUTLET

BACKGROUND OF THE INVENTION

1. Field of the Invention

The present invention relates to an electrical outlet and more particularly pertains an electrical outlet for providing electrical power and over-current protection for electrical devices.

2. Description of the Prior Art

The use of electrical outlets is known in the prior art. More specifically, electrical outlets heretofore devised and utilized for the purpose of providing electrical power are known to consist basically of familiar, expected and obvious structural configurations, notwithstanding the myriad of designs encompassed by the crowded prior art which have been developed for the fulfillment of countless objectives and requirements.

By way of example, the prior art discloses in U.S. Pat. Nos. 3,717,836 to Humphreys, 3,938,068 to Hagan, 4,249,035 to Watley, 4,951,025 to Finnegan, and 3,622,840 to Kahn electrical outlet receptacle apparatuses.

While these devices fulfill their respective, particular objective and requirements, the aforementioned patents do not describe an electrical outlet that provides electrical power, over-current protection, and an indication of whether the outlet is in a normal or over-current state.

In this respect, the electrical outlet according to the present invention substantially departs from the conventional concepts and designs of the prior art, and in doing so provides an apparatus primarily developed for the purpose of providing electrical power and over-current protection for electrical devices.

Therefore, it can be appreciated that there exists a continuing need for new and improved electrical outlet which can be used for providing electrical power and over-current protection for electrical devices. In this regard, the present invention substantially fulfills this need.

SUMMARY OF THE INVENTION

In the view of the foregoing disadvantages inherent in the known types of electrical outlets now present in the prior art, the present invention provides an improved electrical outlet. As such, the general purpose of the present invention, which will be described subsequently in greater detail, is to provide a new and improved electrical outlet and method which has all the advantages of the prior art and none of the disadvantages.

To attain this, the present invention essentially comprises a hollow outlet box having a central opening, a space therein, a peripheral edge therearound disposed near the central opening thereof, a wire hole disposed on one of the sides of the outlet box, a clamp connector disposed within the hole and adapted to couple a power cable to the outlet box and an upper mounting hole and a lower mounting hole disposed on the peripheral edge for mounting the outlet box to an external structure; a hollow receptacle box having a central opening, a space therein, and a peripheral edge therearound disposed near the central opening thereof, the receptacle box further having a pair of electrical receptacles disposed therein, each receptacle having a positive terminal, a negative terminal, and a ground terminal coupled thereto, each terminal adapted to receive a terminal wire of a power cable, each electrical receptacle adapted to receive an external male connector plug of an electrical device, pairs of electrical contacts coupled to the receptacle box and adapted and aligned to receive respective male connector plugs through their respective electrical receptacle, a fuse coupled between each pair of contacts and the respective positive terminal for discontinuing the conduction of electrical power if the maximum amperage rating is exceeded, an indicator light coupled between the fuse and the electrical contacts for providing an indication when the maximum amperage rating is exceeded in each respective receptacle, and a breakaway tab coupled between the positive terminals of each receptacle whereby allowing a user to isolate the pair of receptacles from each other and make one active at all times and the other controlled with an external switch, and a receptacle cover coupled over the central opening of the receptacle box adjacent to the peripheral edge thereof to seal the receptacles therein, the receptacle cover having a pair of holes disposed thereon to allow access to the receptacles; a cover plate adapted for securing the receptacle box adjacent to a wall, the cover plate having a pair of receptacle holes disposed thereon to allow access to the receptacles, an indicator hole for allowing light from the indicator light to pass therethrough for viewing, and a screw hole for securing the cover plate to the receptacle box; and a plurality of screws for securing the receptacle box to the outlet box and the cover plate to the receptacle cover.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved electrical outlet which has all the advantages of the prior art electrical outlets and none of the disadvantages.

It is another object of the present invention to provide a new and improved electrical outlet which may be easily and efficiently manufactured and marketed.

It is a further object of the present invention to provide a new and improved electrical outlet which is of durable and reliable construction.

An even further object of the present invention is to provide a new and improved electrical outlet which is susceptible of a low cost of manufacture with regard to both materials and labor, and which accordingly is then susceptible of low prices of sale to the consuming public, thereby making such an electrical outlet economically available to the buying public.

Still yet another object of the present invention is to provide a new and improved electrical outlet which provides in the apparatuses and methods of the prior art some of the advantages thereof, while simultaneously overcoming some of the disadvantages normally associated therewith.

Even still another object of the present invention is to provide a new and improved electrical outlet for providing electrical power and over-current protection for electrical devices.

Even still another object of the present invention is to provide a new and improved electrical outlet that provides an indication of normal and over-current states.

Even still another object of the present invention is to provide a new and improved electrical outlet that can be used with a variety of power receptacles having a variety of power ratings.

Even still another object of the present invention is to provide a new and improved electrical outlet that can be used in existing electrical circuits without modifying the electrical wiring therein.

Even still another object of the present invention is to provide a new and improved electrical outlet that can be used to prevent electrical fires.

Even still another object of the present invention is to provide a new and improved electrical outlet that can be utilized in both indoor and outdoor environments.

Lastly, it is an object of the present invention to provide a new and improved electrical outlet comprising a hollow receptacle box having a central opening; a plurality of electrical receptacles disposed within the box, each receptacle having a positive terminal, a negative terminal, and a ground terminal coupled thereto, each terminal adapted to receive a terminal wire of a power cable, each electrical receptacle adapted to receive an external male connector plug of an electrical device, pairs of electrical contacts coupled to the receptacle box and adapted to receive respective plugs through their respective electrical receptacles, male connector a fuse coupled between each pair of electrical contacts and their respective positive terminal for discontinuing the conduction of electrical power, means for providing an indication when the maximum power rating is exceeded in each receptacle, and means for allowing a user to configure the receptacles to be active at all times or to be controlled with an external switch; and a receptacle cover coupled over the central opening of the receptacle box adjacent to the peripheral edge thereof to seal the receptacles therein, the receptacle cover having a pair of holes disposed thereon to allow access to the receptacles.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a perspective illustration of the new and improved Electrical Outlet depicting the components constructed in accordance with the principles of the present invention.

FIG. 2 is a front view of the electrical outlet.

FIG. 3 is a side view of the electrical outlet.

FIG. 4 is a view of the electrical outlet taken along the line 4—4 of FIG. 3.

The same reference numerals refer to the same parts through the various Figures.

DESCRIPTION OF THE PREFERRED EMBODIMENT

Figure 5:
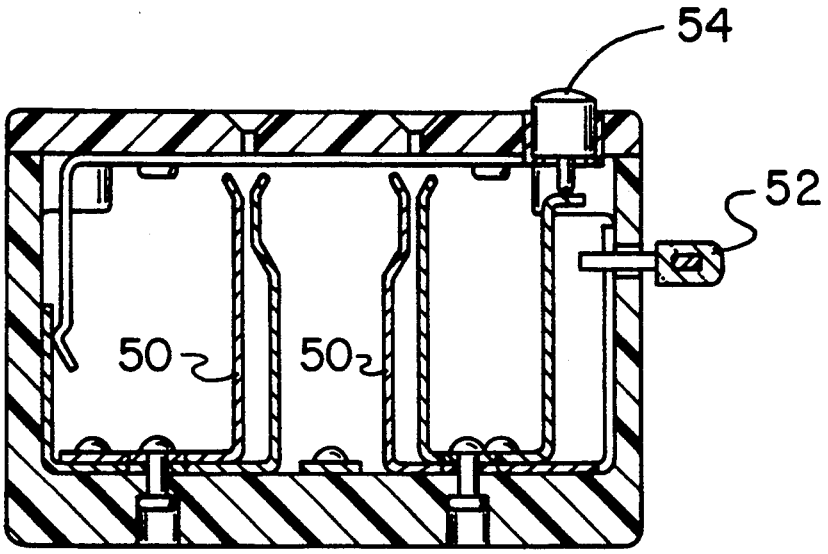
FIG. 5 is a view of the interior of the electrical outlet taken along the line 5—5 of FIG. 2.
Figure 6:
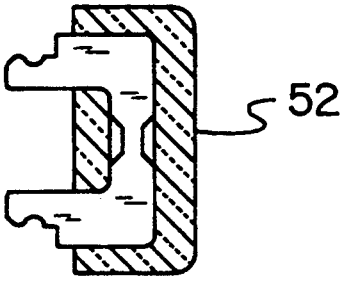
FIG. 6 is a top view of a fuse of the electrical outlet constructed in accordance with the principles of the present invention.

With reference now to the drawings, and in particular, to FIG. 1 thereof, the preferred embodiment of the new and improved electrical outlet embodying the principles and concepts of the present invention and generally designated by the reference number 10 will be described.

Specifically the invention includes four major components. The major components are the outlet box, hollow receptacle box, cover plate and screws. These components are interrelated to provide the intended function.

More specifically it will be noted in the various Figures that the first major component is the hollow outlet box 12. The box has a central opening 14, a space 16 therein, and a peripheral edge 18 therearound disposed near the central opening thereof. The box includes a wire hole 20 disposed on one of the sides of the outlet box. A clamp connector 22 is disposed within the hole and adapted to couple a power cable to the outlet box. A pair of mounting holes 24 are disposed on the upper and lower extent of the peripheral edge for mounting the outlet box to an external structure.

The second major component is the hollow receptacle box 26. The receptacle box has a central opening 28, a space 30 therein, and a peripheral edge 32 therearound disposed near the central opening thereof. The receptacle box further includes a pair of female connectors, electrical receptacles (female connectors) 34, 36 disposed therein. Each receptacle has a positive terminal 38, a negative terminal 40, and a ground terminal 42 coupled thereto. Each terminal is adapted to receive a terminal wire 44 of a power cable 46 and conduct electrical power. Each electrical receptacle 34, 36 is adapted to receive an external male connector plug of an electrical device. A pair of electrical contacts 50 is coupled to the outlet box 12 and adapted to receive respective male connector plugs through their respective electrical receptacles. Each fuse 52 is coupled between the contacts and the respective positive terminal for discontinuing the conduction of electrical power if the maximum amperage rating is exceeded. Each indicator light 54 is coupled between its respective fuse and respective electrical contacts for providing an indication when the maximum amperage rating is exceeded in each respective receptacle. A breakaway tab 56 is coupled between the positive terminals of each receptacle, allowing a user to isolate the pair of receptacles from each other to make one active at all times and the other controlled with an external switch. A receptacle cover 58 is coupled over the central opening of the receptacle box adjacent to the peripheral edge thereof to seal the receptacles therein. The receptacle cover has a pair of connector holes 60 disposed thereon to allow access to the receptacles.

The third major component is a cover plate 62. The cover plate is adapted for securement of the receptacle box adjacent to a wall. The cover plate has a pair of receptacle holes 64 disposed thereon to allow access to the receptacles 34, 36 in the outlet box 12. The indicator holes 66 are disposed thereon to allow lights from the indicator light 54 to pass therethrough for viewing the status of operation. A screw hole 68 is disposed thereon for securing the cover plate to the receptacle cover 26 of the receptacle box.

The fourth major component is a plurality of screws 70. The screws are used to secure the receptacle box 26 to the outlet box 12 through the mounting holes 24. The screws are also used to secure the cover plate 62 to the receptacle cover 58 through the screw hole 68.

In the preferred embodiment, the electrical outlet has duplex receptacles having a standard household outlet configuration and, depending on the application, uses 15 or 20 amp fuses for over-current protection. The 15 or 20 amp fuses will stop the flow of power within the outlet if the maximum amperage rating is exceeded. The indicator light is turned on if the outlet (receptacle) is operating normally and is turned off if the fuse is blown. A transparent plastic covering indicates when a fuse is blown through circuit overload. The positive terminal is made of brass to indicate a positive electrical connection. A 110 volt AC household line must be attached to the positive terminal to provide a fuse protected circuit. The negative terminal is colored bright silver to indicate a negative electrical connection. The ground terminal is colored green to indicate a ground electrical connection. Unlike temporary multi-outlet strips using built in circuit breakers, this outlet will be placed in a fixed part of an electrical system. The minimal size of the fuse holder compared to an internal breaker will allow the device to be installed in standard outlet boxes. With many thermal sensitive receptacles installed throughout a residence or business, early detection of overloaded outlets, faulty appliances or power cords, as well as fault isolation within a circuit will be possible. Because the outlet does not require modification to the fixed wiring of a residence or building for its use, the outlet can be used in new and old buildings.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by LETTERS PATENT of the United States is as follows:

1. An electrical outlet for supplying electrical power to electrical devices comprising, in combination:

a hollow outlet box having a central opening, a space therein, a peripheral edge therearound disposed near the central opening thereof, a wire hole disposed on one of the sides of the outlet box, a clamp connector disposed within the hole and adapted to couple a power cable to the outlet box and an upper mounting hole and a lower mounting hole disposed on the peripheral edge for mounting the outlet box to an external structure;

a hollow receptacle box having a central opening, a space therein, and a peripheral edge therearound disposed near the central opening thereof, the receptacle box further having a pair of electrical receptacle disposed therein, each receptacle having a positive terminal, a negative terminal, and a ground terminal coupled thereto, each terminal adapted to receive a terminal wire of a power cable, each said electrical receptacle adapted to receive an external male connector plug of an electrical device, pairs of electrical contacts coupled to the receptacle box and adapted and aligned to receive respective male connector plugs through their respective electrical receptacles, a fuse coupled between each pair of electrical contacts and the respective positive terminal for discontinuing the conduction of electrical power if the maximum amperage rating is exceeded, an indicator light coupled between each fuse and its respective electrical contacts for providing an indication when the maximum amperage rating is exceeded in each respective receptacle, and a breakaway tab coupled between the positive terminals of each receptacle whereby allowing a user to isolate the pair of receptacles from each other and make one active at all times and the other controlled with an external switch, and a receptacle cover coupled over the central opening of the receptacle box adjacent to the peripheral edge thereof to seal the receptacles therein, the receptacle cover having a pair of holes disposed thereon to allow access to the receptacles;

a cover plate adapted for securing the receptacles box adjacent to a wall, the cover plate having a pair of receptacle holes disposed thereon to allow access to the receptacles, indicator holes for allowing light from the indicator lights to pass therethrough for viewing, and a screw hole for securing the cover plate to the receptacle box; and a plurality of screws for securing the receptacle box to the outlet box and the cover plate to the receptacle cover.

2. An electrical outlet for supplying electrical power to electrical devices comprising:

a hollow outlet receptacle box having a central opening;

a plurality of electrical receptacles disposed within the box, each receptacle having a positive terminal, a negative terminal, and a ground terminal coupled thereto, each terminal adapted to receive a terminal wire of a power cable, each said electrical receptacle adapted to receive an external male connector plug of an electrical device, pairs of electrical contacts coupled to the receptacle box and adapted to receive respective male connector plugs through their respective electrical receptacles, a fuse coupled between each pair of electrical contacts and the respective positive terminal for discontinuing the conduction of electrical power, means for providing an indication when the maximum power rating is exceeded in each receptacle, and means for allowing a user to configure the receptacles to be active at all times or to be controlled with an external switch; and a receptacle cover coupled over the central opening of the receptacle box adjacent to the peripheral edge thereof to seal the receptacles therein, the receptacle cover having a pair of holes disposed thereon to allow access to the receptacles.

* * * * *